US011970808B2

(12) United States Patent
Chung et al.

(10) Patent No.: US 11,970,808 B2
(45) Date of Patent: Apr. 30, 2024

(54) METHOD FOR IMPLEMENTING CLEANING CYCLES IN COMMERCIAL WASHING MACHINE APPLIANCES

(71) Applicant: Haier US Appliance Solutions, Inc., Wilmington, DE (US)

(72) Inventors: Myunggeon Chung, Seoul (KR); Je Kwon Yoon, Seongnam (KR); Jaewon Jo, Seongnam-si (KR)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 17/715,285

(22) Filed: Apr. 7, 2022

(65) Prior Publication Data

US 2023/0323583 A1 Oct. 12, 2023

(51) Int. Cl.

| | |
|---|---|
| ***D06F 33/43*** | (2020.01) |
| *D06F 101/20* | (2020.01) |
| *D06F 103/68* | (2020.01) |
| *D06F 105/54* | (2020.01) |
| *D06F 105/58* | (2020.01) |

(52) U.S. Cl.

CPC ..... *D06F 33/43* (2020.02); *D06F 2101/20* (2020.02); *D06F 2103/68* (2020.02); *D06F 2105/54* (2020.02); *D06F 2105/58* (2020.02)

(58) Field of Classification Search

CPC ..... D06F 31/00; D06F 33/43; D06F 33/69; D06F 35/008; D06F 2101/00; D06F 2101/20; D06F 2103/68; D06F 2103/70; D06F 2105/54; D06F 2105/58

See application file for complete search history.

(56) References Cited

FOREIGN PATENT DOCUMENTS

| | | | |
|---|---|---|---|
| CN | 107845207 | A | 3/2018 |
| CN | 108978118 | A | 12/2018 |
| CN | 109023836 | A | 12/2018 |
| CN | 109989221 | B | 6/2020 |
| CN | 112210956 | A | 1/2021 |
| CN | 112301646 | A | 2/2021 |
| WO | WO-2021088737 | A1 * | 5/2021 |

OTHER PUBLICATIONS

Machine Translation of WO-2021088737-A1, Matsushita et al., May 2021. (Year: 2021).*

* cited by examiner

*Primary Examiner* — David G Cormier
(74) *Attorney, Agent, or Firm* — Dority & Manning, P.A.

(57) ABSTRACT

A method of operating a washing machine appliance in a commercial laundromat setting includes receiving a request to start a new wash cycle from a user of the washing machine appliance, determining that a self-clean condition exists, identifying an anticipated laundromat capacity, determining that the anticipated laundromat capacity falls below a predetermined capacity threshold, prompting the user to initiate a self-clean cycle in response to determining that the self-clean condition exists and that the anticipated laundromat capacity falls below the predetermined capacity threshold, receiving a command to initiate the self-clean cycle from the user, and initiating the self-clean cycle and providing the user with an incentive for initiating the self-clean cycle.

16 Claims, 4 Drawing Sheets

METHOD FOR IMPLEMENTING CLEANING CYCLES IN COMMERCIAL WASHING MACHINE APPLIANCES

FIELD OF THE INVENTION

The present subject matter relates generally to laundry appliances, and more particularly, to methods of implementing cleaning cycles in commercial laundry appliances.

BACKGROUND OF THE INVENTION

Washing machine appliances generally include a cabinet that receives a tub for containing wash and rinse water. A wash basket is rotatably mounted within the tub. A drive assembly is coupled to the tub and configured to rotate the wash basket within the tub in order to cleanse articles within the wash basket. Upon completion of a wash cycle, a pump assembly can be used to rinse and drain soiled water to a draining system. Some washing machine appliances may also rotate the wash basket at a relatively high speed for a spin cycle to further drain or shed water from articles within the wash basket.

During operation of washing machine appliances, dirt, grime, soil, mildew, or other undesirable build-up may be deposited on various surfaces within the appliance. For example, build-up may result from various minerals or particulates within the supply water, from wash additives that are not fully rinsed away after a cycle, etc. Other substances such as dirt, dyes, and textile particulates may also be released into the fluids from the laundry articles during the cleaning process. These substances may have a tendency to build up on the wash tub or other components over time, forming a film or residue. Furthermore, the residue or build-up can dry and/or remain in place on the drum, particularly during periods of non-use between cycles. As the appliance is used repeatedly over various cleaning cycles, such residue may accumulate. If build-up is not periodically removed, bacteria can grow and develop an unpleasant odor.

Washing machine appliances may be programmed to perform self-clean cycles to try and remove build-up or residue. However, users may frequently fail to run such cycles at regular intervals. Moreover, in certain applications, such as commercial laundromat applications, users rarely run such cycles. In addition, commercial laundry owners often fail to run these cycles, and it is practically difficult to maintain cleanliness of commercial washers, e.g., due to the frequent usage and minimal downtime of the units.

Accordingly, an improved system for maintaining the cleanliness of washing machine appliances is desired. More specifically, a method of ensuring periodic cleaning of commercial laundry units would be particularly beneficial.

BRIEF DESCRIPTION OF THE INVENTION

Aspects and advantages of the invention will be set forth in part in the following description, or may be apparent from the description, or may be learned through practice of the invention.

In one exemplary embodiment, a method of operating a washing machine appliance includes receiving a request to start a new wash cycle from a user, determining that a self-clean condition exists, identifying an anticipated laundromat capacity, determining that the anticipated laundromat capacity falls below a predetermined capacity threshold, prompting the user to initiate a self-clean cycle in response to determining that the self-clean condition exists and that the anticipated laundromat capacity falls below the predetermined capacity threshold, receiving a command to initiate the self-clean cycle from the user, and initiating the self-clean cycle.

In another exemplary embodiment, a washing machine appliance operating in a commercial laundromat is provided including a wash tub positioned within a cabinet, a wash basket rotatably mounted within the wash tub and defining a wash chamber configured for receiving a load of clothes, a motor assembly mechanically coupled to the wash basket for selectively rotating the wash basket, and a controller operably coupled to the motor assembly. The controller is configured to receive a request to start a new wash cycle from a user, determine that a self-clean condition exists, identify an anticipated laundromat capacity, determine that the anticipated laundromat capacity falls below a predetermined capacity threshold, prompt the user to initiate a self-clean cycle in response to determining that the self-clean condition exists and that the anticipated laundromat capacity falls below the predetermined capacity threshold, receive a command to initiate the self-clean cycle from the user, and initiate the self-clean cycle.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
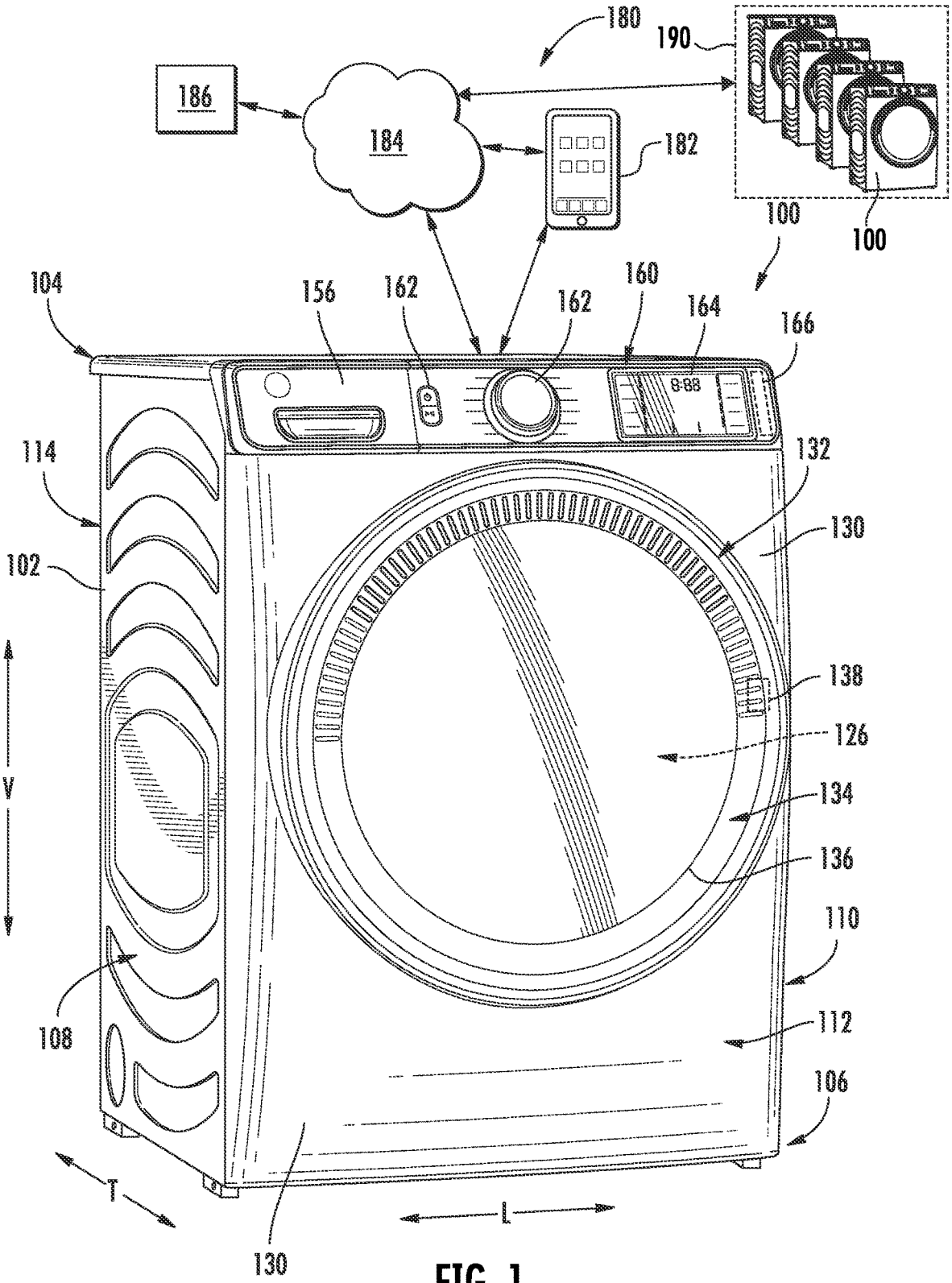
FIG. 1 provides a perspective view of an exemplary washing machine appliance according to an exemplary embodiment of the present subject matter.

Repeat use of reference characters in the present specification and drawings is intended to represent the same or analogous features or elements of the present invention.

DETAILED DESCRIPTION OF THE INVENTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined and/or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 10 percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
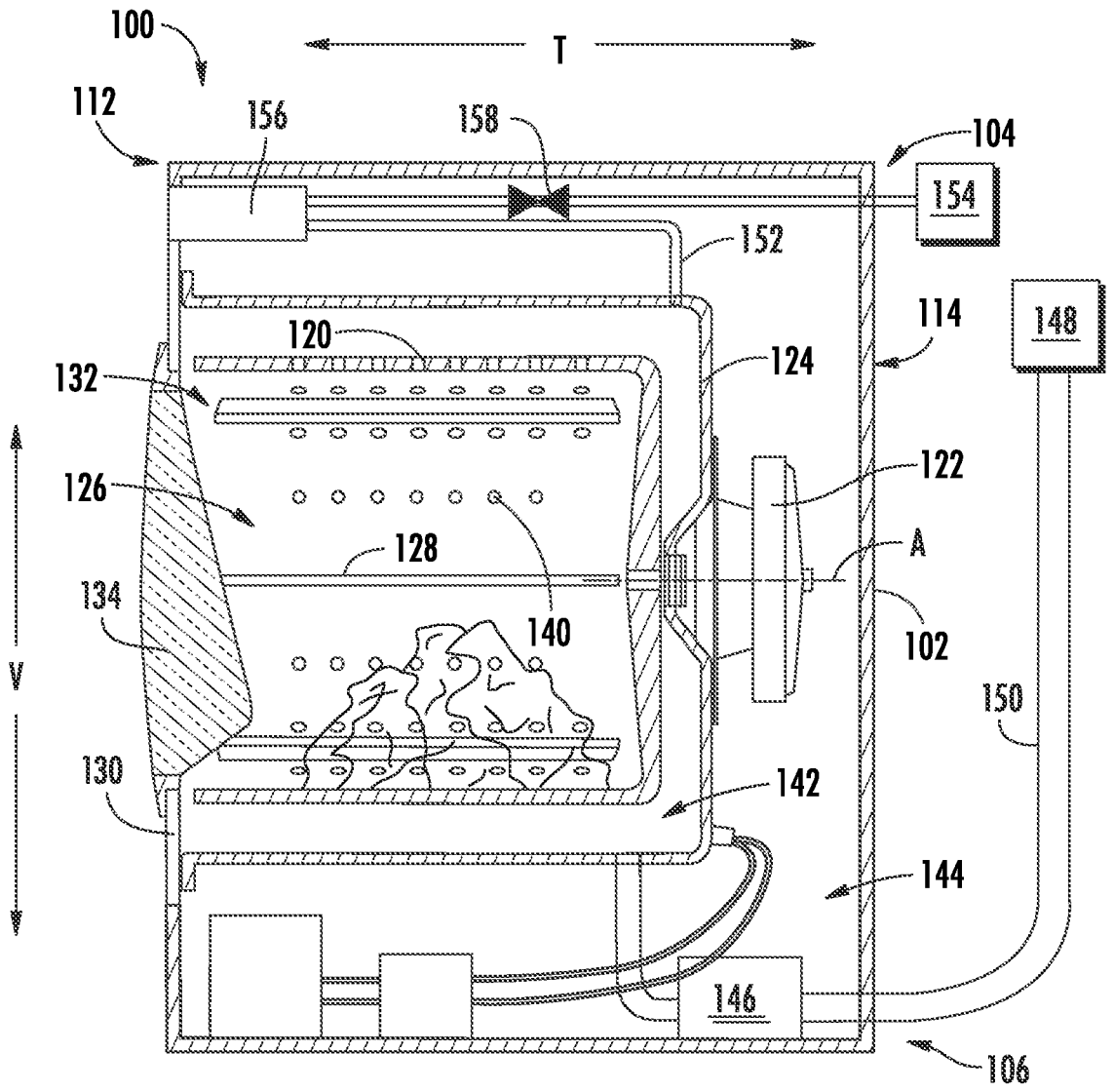
FIG. 2 provides a side cross-sectional view of the exemplary washing machine appliance of FIG. 1.

Referring now to the figures, an exemplary laundry appliance that may be used to implement aspects of the present subject matter will be described. Specifically, FIG. 1 is a perspective view of an exemplary horizontal axis washing machine appliance 100 and FIG. 2 is a side cross-sectional view of washing machine appliance 100. As illustrated, washing machine appliance 100 generally defines a vertical direction V, a lateral direction L, and a transverse direction T, each of which is mutually perpendicular, such that an orthogonal coordinate system is generally defined.

According to exemplary embodiments, washing machine appliance 100 includes a cabinet 102 that is generally configured for containing and/or supporting various components of washing machine appliance 100 and which may also define one or more internal chambers or compartments of washing machine appliance 100. In this regard, as used herein, the terms "cabinet," "housing," and the like are generally intended to refer to an outer frame or support structure for washing machine appliance 100, e.g., including any suitable number, type, and configuration of support structures formed from any suitable materials, such as a system of elongated support members, a plurality of interconnected panels, or some combination thereof. It should be appreciated that cabinet 102 does not necessarily require an enclosure and may simply include open structure supporting various elements of washing machine appliance 100. By contrast, cabinet 102 may enclose some or all portions of an interior of cabinet 102. It should be appreciated that cabinet 102 may have any suitable size, shape, and configuration while remaining within the scope of the present subject matter.

As illustrated, cabinet 102 generally extends between a top 104 and a bottom 106 along the vertical direction V, between a first side 108 (e.g., the left side when viewed from the front as in FIG. 1) and a second side 110 (e.g., the right side when viewed from the front as in FIG. 1) along the lateral direction L, and between a front 112 and a rear 114 along the transverse direction T. In general, terms such as "left," "right," "front," "rear," "top," or "bottom" are used with reference to the perspective of a user accessing washing machine appliance 100.

Referring to FIG. 2, a wash basket 120 is rotatably mounted within cabinet 102 such that it is rotatable about an axis of rotation A. A motor 122, e.g., such as a pancake motor, is in mechanical communication with wash basket 120 to selectively rotate wash basket 120 (e.g., during an agitation or a rinse cycle of washing machine appliance 100). Wash basket 120 is received within a wash tub 124 and defines a wash chamber 126 that is configured for receipt of articles for washing. The wash tub 124 holds wash and rinse fluids for agitation in wash basket 120 within wash tub 124. As used herein, "wash fluid" may refer to water, detergent, fabric softener, bleach, or any other suitable wash additive or combination thereof. Indeed, for simplicity of discussion, these terms may all be used interchangeably herein without limiting the present subject matter to any particular "wash fluid."

Wash basket 120 may define one or more agitator features that extend into wash chamber 126 to assist in agitation and cleaning articles disposed within wash chamber 126 during operation of washing machine appliance 100. For example, as illustrated in FIG. 2, a plurality of ribs 128 extends from basket 120 into wash chamber 126. In this manner, for example, ribs 128 may lift articles disposed in wash basket 120 during rotation of wash basket 120.

Referring generally to FIGS. 1 and 2, cabinet 102 also includes a front panel 130 which defines an opening 132 that permits user access to wash basket 120 of wash tub 124. More specifically, washing machine appliance 100 includes a door 134 that is positioned over opening 132 and is rotatably mounted to front panel 130. In this manner, door 134 permits selective access to opening 132 by being movable between an open position (not shown) facilitating access to a wash tub 124 and a closed position (FIG. 1) prohibiting access to wash tub 124.

A window 136 in door 134 permits viewing of wash basket 120 when door 134 is in the closed position, e.g., during operation of washing machine appliance 100. Door 134 also includes a handle (not shown) that, e.g., a user may pull when opening and closing door 134. Further, although door 134 is illustrated as mounted to front panel 130, it should be appreciated that door 134 may be mounted to another side of cabinet 102 or any other suitable support according to alternative embodiments. Washing machine appliance 100 may further include a latch assembly 138 (see FIG. 1) that is mounted to cabinet 102 and/or door 134 for selectively locking door 134 in the closed position and/or confirming that the door is in the closed position. Latch assembly 138 may be desirable, for example, to ensure only secured access to wash chamber 126 or to otherwise ensure and verify that door 134 is closed during certain operating cycles or events.

Referring again to FIG. 2, wash basket 120 also defines a plurality of perforations 140 in order to facilitate fluid communication between an interior of basket 120 and wash tub 124. A sump 142 is defined by wash tub 124 at a bottom of wash tub 124 along the vertical direction V. Thus, sump 142 is configured for receipt of and generally collects wash fluid during operation of washing machine appliance 100. For example, during operation of washing machine appliance 100, wash fluid may be urged by gravity from basket 120 to sump 142 through plurality of perforations 140.

A drain pump assembly 144 is located beneath wash tub 124 and is in fluid communication with sump 142 for periodically discharging soiled wash fluid from washing machine appliance 100. Drain pump assembly 144 may generally include a drain pump 146 which is in fluid communication with sump 142 and with an external drain 148 through a drain hose 150. During a drain cycle, drain pump 146 urges a flow of wash fluid from sump 142, through drain hose 150, and to external drain 148. More specifically, drain pump 146 includes a motor (not shown) which is energized during a drain cycle such that drain pump 146 draws wash fluid from sump 142 and urges it through drain hose 150 to external drain 148.

Washing machine appliance 100 may further include a wash fluid dispenser that is generally configured for dispensing a flow of water, wash fluid, etc. into wash tub 124. For example, a spout 152 is configured for directing a flow of fluid into wash tub 124. For example, spout 152 may be in fluid communication with a water supply 154 (FIG. 2) in order to direct fluid (e.g., clean water or wash fluid) into wash tub 124. Spout 152 may also be in fluid communication with the sump 142. For example, pump assembly 144 may direct wash fluid disposed in sump 142 to spout 152 in order to circulate wash fluid in wash tub 124.

As illustrated in FIG. 2, a detergent drawer 156 is slidably mounted within front panel 130. Detergent drawer 156 receives a wash additive (e.g., detergent, fabric softener, bleach, or any other suitable liquid or powder) and directs the fluid additive to wash tub 124 during operation of washing machine appliance 100. According to the illustrated embodiment, detergent drawer 156 may also be fluidly coupled to spout 152 to facilitate the complete and accurate dispensing of wash additive. It should be appreciated that according to alternative embodiments, these wash additives could be dispensed automatically via a bulk dispensing unit (not shown). Other systems and methods for providing wash additives are possible and within the scope of the present subject matter.

In addition, a water supply valve 158 may provide a flow of water from a water supply source (such as a municipal water supply 154) into detergent dispenser 156 and into wash tub 124. In this manner, water supply valve 158 may generally be operable to supply water into detergent dispenser 156 to generate a wash fluid, e.g., for use in a wash cycle, or a flow of fresh water, e.g., for a rinse cycle. It should be appreciated that water supply valve 158 may be positioned at any other suitable location within cabinet 102. In addition, although water supply valve 158 is described herein as regulating the flow of "wash fluid," it should be appreciated that this term includes, water, detergent, other additives, or some mixture thereof.

During operation of washing machine appliance 100, laundry items are loaded into wash basket 120 through opening 132, and washing operation is initiated through operator manipulation of one or more input selectors or using a remote device (see below). Wash tub 124 is filled with water, detergent, and/or other fluid additives, e.g., via spout 152 and/or detergent drawer 156. One or more valves (e.g., water supply valve 158) can be controlled by washing machine appliance 100 to provide for filling wash basket 120 to the appropriate level for the amount of articles being washed and/or rinsed. By way of example for a wash mode, once wash basket 120 is properly filled with fluid, the contents of wash basket 120 can be agitated (e.g., with ribs 128) for washing of laundry items in wash basket 120.

After the agitation phase of the wash cycle is completed, wash tub 124 can be drained. Laundry articles can then be rinsed by again adding fluid to wash tub 124, depending on the particulars of the cleaning cycle selected by a user. Ribs 128 may again provide agitation within wash basket 120. One or more spin cycles may also be used. In particular, a spin cycle may be applied after the wash cycle and/or after the rinse cycle in order to wring wash fluid from the articles being washed. During a final spin cycle, basket 120 is rotated at relatively high speeds and drain assembly 144 may discharge wash fluid from sump 142. After articles disposed in wash basket 120 are cleaned, washed, and/or rinsed, the user can remove the articles from wash basket 120, e.g., by opening door 134 and reaching into wash basket 120 through opening 132.

Referring again to FIG. 1, washing machine appliance 100 may include a control panel 160 that may represent a general-purpose Input/Output ("GPIO") device or functional block for washing machine appliance 100. In some embodiments, control panel 160 may include or be in operative communication with one or more user input devices 162, such as one or more of a variety of digital, analog, electrical, mechanical, or electro-mechanical input devices including rotary dials, control knobs, push buttons, toggle switches, selector switches, and touch pads. Additionally, washing machine appliance 100 may include a display 164, such as a digital or analog display device generally configured to provide visual feedback regarding the operation of washing machine appliance 100. For example, display 164 may be provided on control panel 160 and may include one or more status lights, screens, or visible indicators. According to exemplary embodiments, user input devices 162 and display 164 may be integrated into a single device, e.g., including one or more of a touchscreen interface, a capacitive touch panel, a liquid crystal display (LCD), a plasma display panel (PDP), a cathode ray tube (CRT) display, or other informational or interactive displays.

Washing machine appliance 100 may further include or be in operative communication with a processing device or a controller 166 that may be generally configured to facilitate appliance operation. In this regard, control panel 160, user input devices 162, and display 164 may be in communication with controller 166 such that controller 166 may receive control inputs from user input devices 162, may display information using display 164, and may otherwise regulate operation of washing machine appliance 100. For example, signals generated by controller 166 may operate washing machine appliance 100, including any or all system components, subsystems, or interconnected devices, in response to the position of user input devices 162 and other control commands. Control panel 160 and other components of washing machine appliance 100 may be in communication with controller 166 via, for example, one or more signal lines or shared communication busses. In this manner, Input/Output ("I/O") signals may be routed between controller 166 and various operational components of washing machine appliance 100.

As used herein, the terms "processing device," "computing device," "controller," or the like may generally refer to any suitable processing device, such as a general or special purpose microprocessor, a microcontroller, an integrated circuit, an application specific integrated circuit (ASIC), a digital signal processor (DSP), a field-programmable gate array (FPGA), a logic device, one or more central processing units (CPUs), a graphics processing units (GPUs), processing units performing other specialized calculations, semiconductor devices, etc. In addition, these "controllers" are not necessarily restricted to a single element but may include any suitable number, type, and configuration of processing devices integrated in any suitable manner to facilitate appliance operation. Alternatively, controller 166 may be constructed without using a microprocessor, e.g., using a combination of discrete analog and/or digital logic circuitry (such as switches, amplifiers, integrators, comparators, flip-flops, AND/OR gates, and the like) to perform control functionality instead of relying upon software.

Controller 166 may include, or be associated with, one or more memory elements or non-transitory computer-readable storage mediums, such as RAM, ROM, EEPROM, EPROM, flash memory devices, magnetic disks, or other suitable memory devices (including combinations thereof). These memory devices may be a separate component from the processor or may be included onboard within the processor. In addition, these memory devices can store information and/or data accessible by the one or more processors, including instructions that can be executed by the one or more processors. It should be appreciated that the instructions can be software written in any suitable programming language or can be implemented in hardware. Additionally, or alternatively, the instructions can be executed logically and/or virtually using separate threads on one or more processors.

For example, controller 166 may be operable to execute programming instructions or micro-control code associated with an operating cycle of washing machine appliance 100. In this regard, the instructions may be software or any set of instructions that when executed by the processing device, cause the processing device to perform operations, such as running one or more software applications, displaying a user interface, receiving user input, processing user input, etc. Moreover, it should be noted that controller 166 as disclosed herein is capable of and may be operable to perform any methods, method steps, or portions of methods of appliance operation. For example, in some embodiments, these methods may be embodied in programming instructions stored in the memory and executed by controller 166.

The memory devices may also store data that can be retrieved, manipulated, created, or stored by the one or more processors or portions of controller 166. The data can include, for instance, data to facilitate performance of methods described herein. The data can be stored locally (e.g., on controller 166) in one or more databases and/or may be split up so that the data is stored in multiple locations. In addition, or alternatively, the one or more database(s) can be connected to controller 166 through any suitable network(s), such as through a high bandwidth local area network (LAN) or wide area network (WAN). In this regard, for example, controller 166 may further include a communication module or interface that may be used to communicate with one or more other component(s) of washing machine appliance 100, controller 166, an external appliance controller, or any other suitable device, e.g., via any suitable communication lines or network(s) and using any suitable communication protocol. The communication interface can include any suitable components for interfacing with one or more network(s), including for example, transmitters, receivers, ports, controllers, antennas, or other suitable components.

Referring again to FIG. 1, a schematic diagram of an external communication system 180 will be described according to an exemplary embodiment of the present subject matter. In general, external communication system 180 is configured for permitting interaction, data transfer, and other communications between washing machine appliance 100 and one or more external devices. For example, this communication may be used to provide and receive operating parameters, user instructions or notifications, performance characteristics, user preferences, or any other suitable information for improved performance of washing machine appliance 100. In addition, it should be appreciated that external communication system 180 may be used to transfer data or other information to improve performance of one or more external devices or appliances and/or improve user interaction with such devices.

For example, external communication system 180 permits controller 166 of washing machine appliance 100 to communicate with a separate device external to washing machine appliance 100, referred to generally herein as an external device 182. As described in more detail below, these communications may be facilitated using a wired or wireless connection, such as via a network 184. In general, external device 182 may be any suitable device separate from washing machine appliance 100 that is configured to provide and/or receive communications, information, data, or commands from a user. In this regard, external device 182 may be, for example, a personal phone, a smartphone, a tablet, a laptop or personal computer, a wearable device, a smart home system, or another mobile or remote device.

In addition, a remote server 186 may be in communication with washing machine appliance 100 and/or external device 182 through network 184. In this regard, for example, remote server 186 may be a cloud-based server 186, and is thus located at a distant location, such as in a separate state, country, etc. According to an exemplary embodiment, external device 182 may communicate with a remote server 186 over network 184, such as the Internet, to transmit/receive data or information, provide user inputs, receive user notifications or instructions, interact with or control washing machine appliance 100, etc. In addition, external device 182 and remote server 186 may communicate with washing machine appliance 100 to communicate similar information.

In general, communication between washing machine appliance 100, external device 182, remote server 186, and/or other user devices or appliances may be carried using any type of wired or wireless connection and using any suitable type of communication network, non-limiting examples of which are provided below. For example, external device 182 may be in direct or indirect communication with washing machine appliance 100 through any suitable wired or wireless communication connections or interfaces, such as network 184. For example, network 184 may include one or more of a local area network (LAN), a wide area network (WAN), a personal area network (PAN), the Internet, a cellular network, any other suitable short- or long-range wireless networks, etc. In addition, communications may be transmitted using any suitable communications devices or protocols, such as via Bluetooth®, Zigbee®, wireless radio, laser, infrared, Ethernet type devices and interfaces, etc. In addition, such communication may use a variety of communication protocols (e.g., TCP/IP, HTTP, SMTP, FTP), encodings or formats (e.g., HTML, XML), and/or protection schemes (e.g., VPN, secure HTTP, SSL).

External communication system 180 is described herein according to an exemplary embodiment of the present subject matter. However, it should be appreciated that the exemplary functions and configurations of external communication system 180 provided herein are used only as examples to facilitate description of aspects of the present subject matter. System configurations may vary, other communication devices may be used to communicate directly or indirectly with one or more associated appliances, other communication protocols and steps may be implemented, etc. These variations and modifications are contemplated as within the scope of the present subject matter.

While described in the context of a specific embodiment of horizontal axis washing machine appliance 100, using the teachings disclosed herein it will be understood that horizontal axis washing machine appliance 100 is provided by way of example only. Other washing machine appliances having different configurations, different appearances, and/or different features may also be utilized with the present subject matter as well, e.g., vertical axis washing machine appliances.

Referring still to FIG. 1, washing machine appliance 100 may be utilized as a commercial washer in a laundromat or another commercial setting. In this regard, as used herein, discussion of the use of laundry appliances in a commercial setting may generally refer to the use of the appliance in any location where two or more appliances are provided for use by consumers. These commercial setting are commonly laundromats that include a large number of washers and dryers that are configured for pay-per-use operation, e.g., via cash, coins, digital currency, or other forms of payment.

For example, as shown in FIG. 1, washing machine appliance 100 may be located in a laundromat (e.g., as identified generally by reference numeral 190) along with other washing machine appliances, dryer appliances, etc. In general, each of the laundry appliances (e.g., washers and/or dryers) may all be in operative communication with each other and a remote server 186 through a network 184, as described above. In this manner, these network-connected appliances may communicate with each other to facilitate implementation of the various methods described herein. For example, each washing machine appliance within the laundromat 190 may communicate operating statuses or conditions to the remaining appliances, e.g., to facilitate determination of the actual operating capacity of the laundromat 190, as described in more detail below.

Now that the construction of washing machine appliance 100 and the configuration of controller 166 according to exemplary embodiments have been presented, an exemplary method 200 of operating a washing machine appliance will be described. Although the discussion below refers to the exemplary method 200 of operating washing machine appliance 100, one skilled in the art will appreciate that the exemplary method 200 is applicable to the operation of a variety of other washing machine appliances or laundry appliances in general. In exemplary embodiments, the various method steps as disclosed herein may be performed by controller 166 or a separate, dedicated controller.

Figure 3:
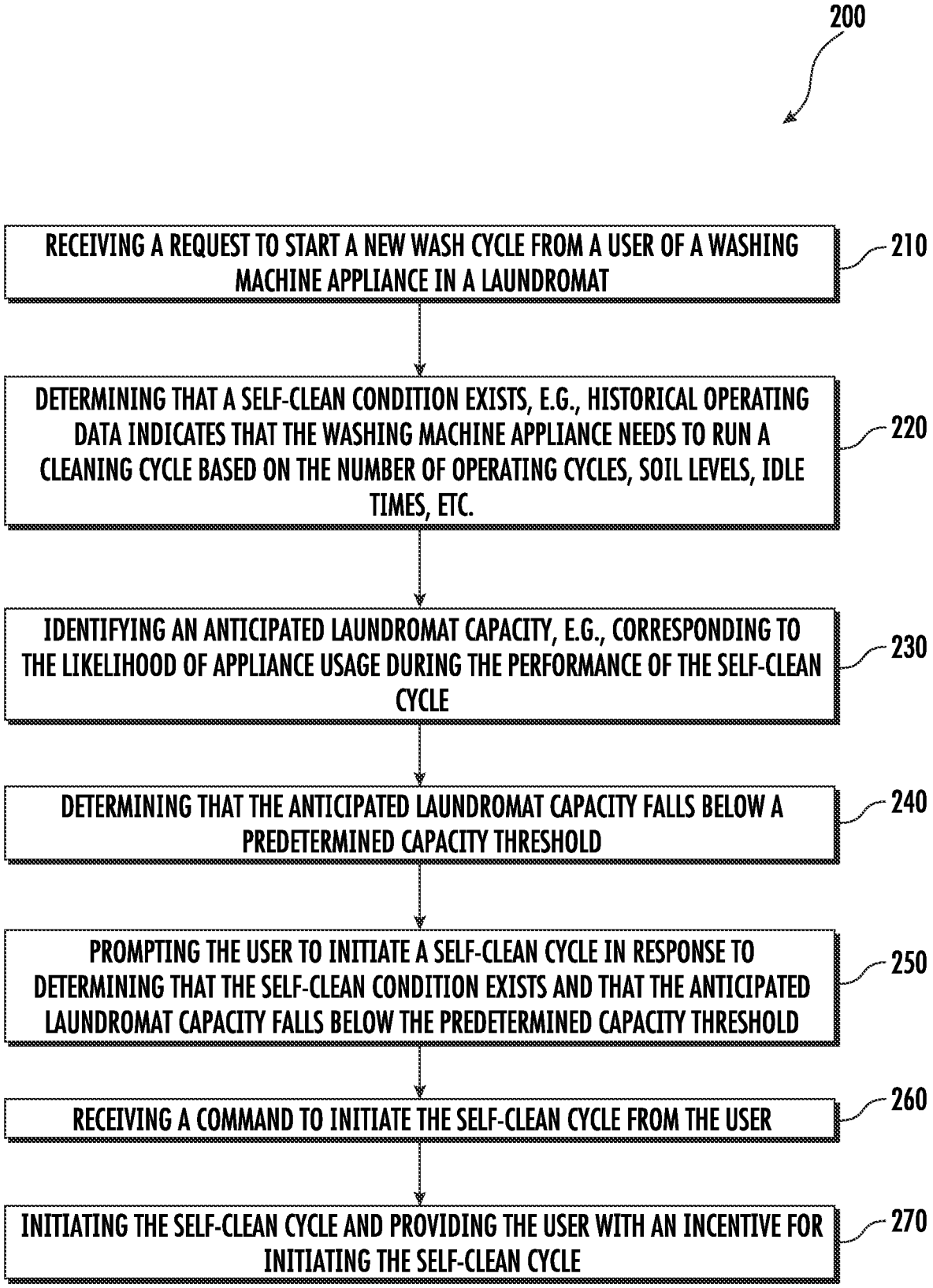
FIG. 3 illustrates a method for operating a washing machine appliance in accordance with one embodiment of the present disclosure.

Referring now to FIG. 3, method 200 includes, at step 210, receiving a request to start a new wash cycle from a user of a washing machine appliance in a laundromat. In this regard, continuing the example from above, washing machine appliance 100 may be used in a commercial laundromat 190. According to an exemplary embodiment, users in a laundromat may have physical or digital wallets that contain credits for performing one or more cycles of the various washers and dryers within a laundromat. For example, these digital credits may be stored on a user's mobile phone (e.g., remote device 182) which may also be used to interact with and operate each of the laundromat appliances.

Accordingly, step 210 may include the actual physical interaction of a user of a laundromat appliance (e.g., wash machining appliance 100) either through a remote device (e.g., such as remote device 182), via control panel 160, etc. The user interaction may proceed as normal where a user powers on the appliance and presses one or more buttons to begin inputting parameters for the performance of an operating cycle. However, as explained briefly above, it may be desirable to periodically clean washing machine appliances for improved performance and user satisfaction. Accordingly, aspects of the present subject matter are directed to methods for incentivizing users of laundromat appliances to initiate self-clean cycles when those cycles are needed.

As understood by one having ordinary skill in the art, a "self-clean" cycle may be performed by a controller of a washing machine appliance by adjusting one or more operating parameters to clean the surfaces and components of the washing machine. For example, such a self-clean cycle may include performing a wash and rinse cycle with no clothes present in the washer. In addition, the water supply may adjust the temperature and volume of water supplied (e.g., to use very hot water), detergent or a specific cleaning agent may be dispensed, spin speeds may be adjusted, draining cycles may be extended, or any other suitable operating parameter adjustments may be made to clean the washing machine. Notably, such a cycle removes dirt, soil, and grime build-up, thereby preventing bacteria, mold, mildew, and odors from forming.

Referring still to FIG. 3, step 220 may include determining that a self-clean condition exists. In this regard, for example, washing machine appliance 100 may utilize historical operating data or other useful data to determine that the washing machine appliance needs to perform a self-clean cycle. The controller of washing machine appliance 100 may make this determination directly or the determination may be made by a remote server in operative communication with washing machine appliance 100. As explained in more detail below, the self-clean condition may exist based on a variety of parameters, such as the number of operating cycles performed between clean cycles, the accumulated soil levels experienced during cleaning cycles, the idle time is between cleaning cycles, etc.

For example, soil and grime may tend to build up within washing machine appliance 100 based at least in part on the number of cycles performed. Accordingly, it may be desirable to perform a self-clean cycle based on a cycle frequency or total cycle count since the previous self-clean cycle. Accordingly, step 220 of determining that the self-clean condition exists may include determining that a predetermined number of cycles has been performed since the performance of a prior self-clean cycle. In this regard, controller 166 may maintain a counter that increases by one count for every operating cycle performed and reset to zero when a self-clean cycle is performed. In the counter reaches the predetermined number of cycles (e.g., 20 cycles, 40 cycles, 60 cycles, etc.), the self-clean condition may be triggered.

In addition, or alternatively, determining that the self-clean condition exists may be based solely on the amount of time since the last self-clean cycle. In this regard, it may be desirable to clean a washing machine appliance once per week, once every two weeks, once a month, once every three months, etc. Accordingly, controller 166 may maintain a timer that counts down from the predetermined amount of time and triggers the self-clean condition when the timer reaches zero. After a self-clean cycle is performed, the timer may reset to the predetermined amount of time and operating of the appliance may proceed as usual.

In addition, or alternatively, soil or grime may tend to build up when the appliance generally experiences larger load sizes. Accordingly, controller 166 of washing machine appliance 100 may monitor soil levels for each operating cycle or a user may input the soil level for each operating cycle. Controller 166 may then accumulate a soil score that factors in the number of cycles performed and their associated soil levels. For example, an operating cycle with little or no soil may be assigned one point, medium soil may be assigned five points, and a heavy soil cycle may be assigned 10 points. After a self-clean cycle, the soil score may be zero and controller 166 may increment the soil score by the cycle points over a number of operating cycles. When the total soil score exceeds a predetermined threshold, the self-clean condition may be triggered.

In addition, or alternatively, soil or grime may tend to build up when the appliance generally experiences loads with larger load sizes (e.g., which is commonly indicative of higher soil level). Accordingly, controller 166 of washing machine appliance 100 may monitor load size for each operating cycle or a user may input the load size for each operating cycle. Controller 166 may then accumulate a load size score that factors in the number of cycles performed in their associated load sizes. For example, an operating cycle with a small load may be assigned one point, a medium load may be assigned five points, and a large load may be assigned ten points. After a self-clean cycle, the load size score may be zero and controller 166 may increment the load size score by the load size points over a number of operating cycles. When the total load size score exceeds a predetermined threshold, the self-clean condition may be triggered.

In addition, or alternatively, mold and/or bacteria tends to grow within a washing machine appliance during periods of nonuse or idle times between wash cycles. Accordingly, step 220 of determining that a self-clean condition exists may include monitoring idle times, e.g., by tracking the amount of time that a washing machine appliance remains in an idle state. When the total accumulated idle state time exceeds the predetermined threshold time, the self-clean condition may be triggered. Although exemplary methods for identifying self-clean conditions are provided herein, it should be appreciated that other reasons for triggering the self-clean condition may exist and are within scope the present subject matter.

Notably, even if the self-clean cycle condition exists, it may be desirable to only perform a self-clean cycle when the appliance is not likely to be used or needed during the performance of the self-clean cycle. In this regard, performing a self-clean cycle when a user may otherwise require use of the washing machine appliance may result in the inability of a user to wash their clothes, financial losses for the laundromat owner, and general user dissatisfaction. Accordingly, step 230 may include identifying an anticipated laundromat capacity, e.g., corresponding to the likelihood of appliance usage during the performance of the self-clean cycle.

In general, the term "anticipated laundromat capacity" is intended to refer to a percentage of washing machine appliances within a laundromat that will be in use within a predetermined time period. According to exemplary embodiments, the anticipated laundromat capacity may be a percentage of appliances in the particular location (e.g., the laundromat 190), e.g., such as 70% appliance usage, 80% appliance usage, etc. Alternatively, the anticipated laundromat capacity may be any other quantitative data related to the likelihood that a washing machine appliance 100 at the laundromat 190 is available for consumer use in the event that another washing machine is taken out of service in order to perform a self-clean cycle.

Notably, there are a variety of ways that washing machine appliance 100 and/or remote server 186 may identify the anticipated laundromat capacity. For example, identifying the anticipated laundromat capacity may include identifying a current laundromat capacity and determining the anticipated laundromat capacity based at least in part on the current laundromat capacity. In this regard, if the current laundromat capacity is very low (e.g., 25% capacity), the maximum anticipated laundromat capacity may be determined by adding a maximum potential increase in percentage of laundromat capacity, e.g., based on historical data. If, for example, that maximum percentage is 35%, the anticipated laundromat capacity may be determined to be 60%. Further, if the self-clean cycle should only be performed when the anticipated laundromat capacity is less than 80%, the self-clean cycle may be performed, as it is unlikely that laundromat usage will increase by 55% within the time period associated with the self-clean cycle.

According to exemplary embodiments, the anticipated laundromat capacity may be the predicted capacity within a specific time period, such as within 30 minutes, within an hour, within two hours, within four hours, etc. Specifically, this predetermined time period may be associated with the amount of time required to perform a self-clean cycle. In this regard, the laundromat capacity may only be relevant if it would affect the users operation of an appliance when desired.

According to exemplary embodiments, the anticipated laundromat capacity may be estimated or otherwise determined using one or more artificial intelligence or machine learning techniques or algorithms. In this regard, for example, a remote server may implement a machine learning algorithm that determines the anticipated laundromat usage during an impending time period, e.g., such as the upcoming hour, the upcoming two hours, the upcoming four hours, etc. This machine learning model may be trained using historical data related to laundromat operation and may include data such as the time of day, popular usage times, holiday schedules, weather data, special events, or any other suitable data. It should be appreciated that any suitable type and/or combination of machine learning techniques may be used according to exemplary embodiments (e.g., such as logistic regression machine learning, etc.).

Step 240 may include determining that the anticipated laundromat capacity falls below a predetermined capacity threshold. In this regard, a user or manufacturer of the appliance may set a predetermined capacity threshold beyond which self-clean cycles should not be performed, e.g., to ensure owner profitability and to reduce the likelihood that the machine is not available when desired by a user. For example, the predetermined capacity threshold may be 80%, 85%, 90%, or greater of the total laundromat capacity. If the anticipated laundromat capacity exceeds this threshold, it may be desirable to prevent operation of a self-clean cycle. By contrast, if the anticipated laundromat capacity falls below this threshold, a self-clean cycle could likely be performed without interrupting the user or affecting laundromat profitability.

Accordingly, step 250 may include prompting the user to initiate a self-clean cycle in response to determining that the self-clean condition exists and that the anticipated laundromat capacity falls below the predetermined capacity threshold. This communication with the user of the appliance may be achieved through control panel 160, a remote device 182, or any other suitable means. For example, washing machine appliance 100 or remote server 186 may send a push notification to a user's mobile phone asking them to implement a self-clean cycle.

Notably, in order to encourage or incentivize users to perform self-clean cycles, aspects of the present subject matter may include providing an incentive for initiating a self-clean cycle. In this regard, the prompt sent to the user may include an offer of an incentive for initiating a self-clean cycle which the user may receive upon initiating the self-clean cycle. According to exemplary embodiments, the incentive may include at least one of a free or discounted wash cycle, a free or discounted dryer cycle in an associated dryer appliance within laundromat 190, or other cycle credits. For example, the laundromat user's personal account may be credited with one or more digital tokens that may be applied to pay for future operating cycles of the appliances within laundromat 190.

Step 260 may include receiving a command to initiate the self-clean cycle from the user and step 270 may include initiating the self-clean cycle and providing the user with an incentive for initiating the self-clean cycle. In this regard, the user may initiate a self-clean cycle after receiving the prompt at step 250. Washing machine appliance 100 may then perform that self-clean cycle and the offered incentives may be credited to the user. For example, the washing machine appliance 100 may instruct the deposit of cycle credits or other incentives into the users account as a result of initiating the self-clean cycle. It should be appreciated that method 200 may further include recommendations to the user as to other appliances that may be open and available for use. In this regard, the user may initiate a self-clean cycle on one appliance and may be assigned to another appliance to perform actual cleaning of a load of clothes.

Notably, if a self-clean condition doesn't exist (e.g., the washing machine appliance does not need to be cleaned), method 200 may further include initiating the new wash cycle immediately upon receiving the request to start the new wash cycle. Similarly, if the anticipated laundromat capacity exceeds the predetermined capacity threshold, method 200 may include proceeding with the new wash cycle. In this regard, if the anticipated laundromat capacity is such that a user may not be able to obtain a new washing machine appliance if they initiate a self-clean cycle on the target washing machine appliance, then the self-clean cycle may be delayed so that the user may have the convenience of performing a wash cycle immediately and the laundromat may obtain payment for such an operating cycle. In addition, a user may simply not wish to initiate a self-clean cycle, so method 200 may further include receiving a command to skip the self-clean cycle and to initiate a new wash cycle from the user. Upon receipt of such a command, the self-clean cycle may be bypassed and the washing cycle may be performed.

Figure 4:
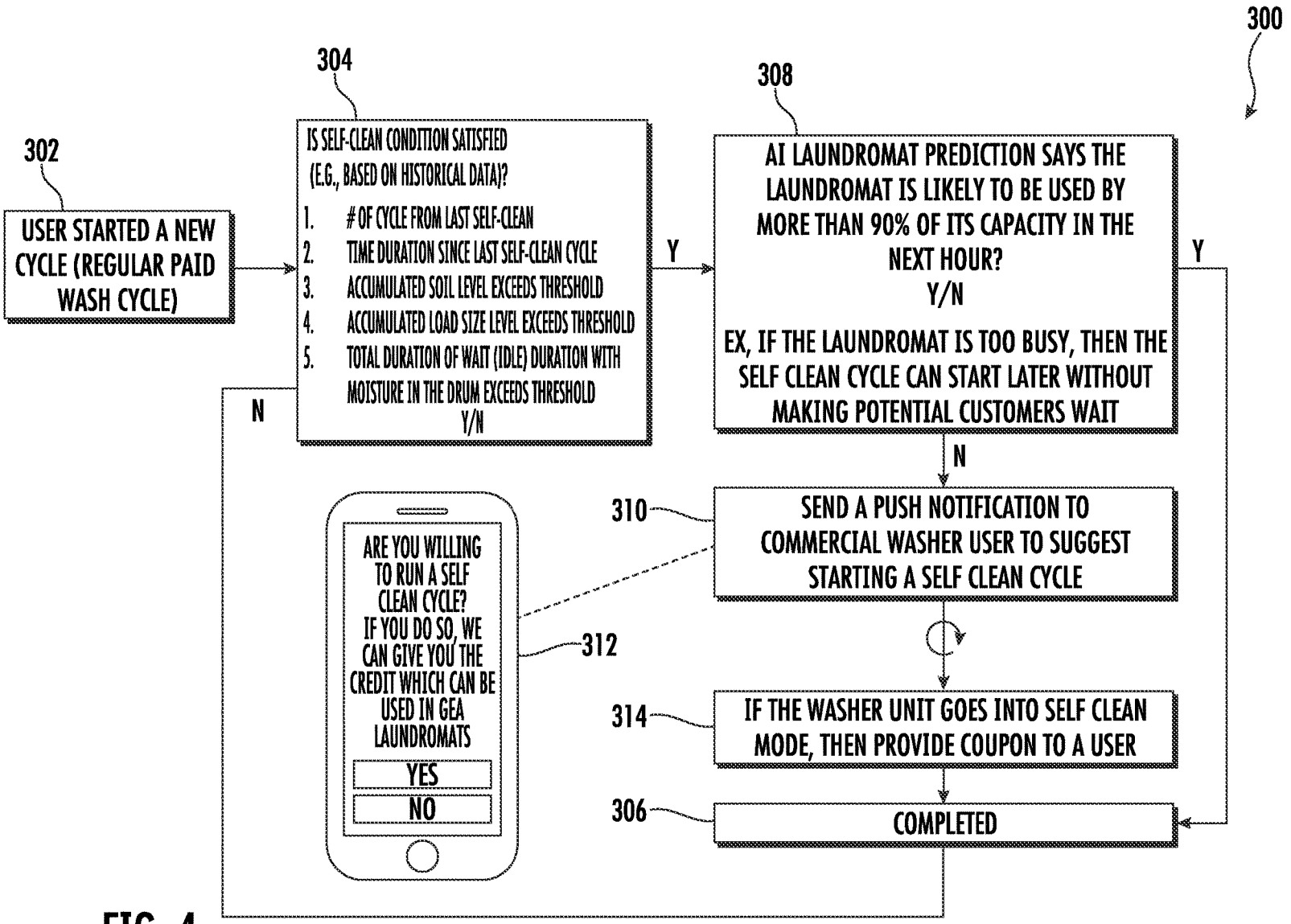
FIG. 4 provides a flow diagram illustrating an exemplary process for incentivizing users to perform self-clean cycles on a commercial washing machine when needed according to an exemplary embodiment of the present subject matter.

Referring now briefly to FIG. 4, an exemplary flow diagram of a method for performing self-clean cycles in a commercial washing machine appliance will be described. More specifically, method 300 may be implemented by washing machine appliance 100. According to exemplary embodiments, method 300 may be similar to or interchangeable with method 200 and may be implemented by controller 166 of washing machine appliance 100.

As shown, at step 302, method 300 may include receiving a request to start a new wash cycle. In this regard, a consumer may have powered on a washing machine appliance and began entering load information to initiate a new cycle. Step 304 may include determining whether a self-clean condition is satisfied (e.g., based on historical data). For example, the self-clean condition may be satisfied if a predetermined number of cycles has passed since last self-clean cycle or a predetermined amount of time has passed since the last self-clean cycle. In addition, the self-clean cycle may be triggered based on accumulated soil levels or load sizes exceeding predetermined thresholds. The self-clean condition may also be triggered if the amount of downtime or idle time between washing cycles exceeds a threshold.

If step 304 results in a determination that the self-clean condition is not satisfied (e.g., such that a self-clean cycle is not needed), method 300 may be completed or ended at step 306. By contrast, if step 304 results in a determination that self-clean condition is satisfied, step 308 may include predicting laundromat usage to determine whether the laundromat will be too busy to initiate the self-clean cycle without making potential customers wait to wash their clothes. This prediction may include determining anticipated laundromat capacity, e.g., based on historical data, machine learning models, or any other data.

If the laundromat is going to be too busy to facilitate the performance of a self-clean cycle, method 300 may proceed to step 306 and the requested wash cycle may be performed. By contrast, if step 308 results in a determination that the laundromat capacity is less than a predetermined threshold, step 310 may include sending a push notification to the user of the washing machine to suggest the commencement of the self-clean cycle. According to an exemplary embodiment, as shown at step 312, the push notification may include an offer for an incentive (e.g., such as cycle credits) for initiating the performance of the self-clean cycle. If the washer subsequently goes into the self-clean mode, step 314 may include providing the user with the incentive or cycle credits.

FIGS. 3 and 4 depict steps performed in a particular order for purposes of illustration and discussion. Those of ordinary skill in the art, using the disclosures provided herein, will understand that the steps of any of the methods discussed herein can be adapted, rearranged, expanded, omitted, or modified in various ways without deviating from the scope of the present disclosure. Moreover, although aspects of methods 200 and 300 are explained using washing machine appliance 100 as an example, it should be appreciated that this method may be applied to operate any suitable laundry appliances, particularly appliances located in laundromats and intended for commercial use.

As explained above, aspects of the present subject matter are generally directed to methods for suggesting to a consumer that a self-clean cycle should be performed in a commercial washer and executing such a self-clean cycle based on the soil level, last self-clean cycle, load size etc. In this regard, commercial washers need to be cleaned regularly as they are used by multiple users frequently which leads to formation of different types of soils (dirt, germs, food particles, bacteria, etc.), which may further lead to improper washing, unpleasant smells, pollution of drum/casing, etc.

The present disclosure includes methods of suggesting or requesting that the consumer execute the self-clean cycle based on the data gathered by the washer, e.g., such as a total wash cycle duration after the last self-clean cycle (tracking total cycle duration), a degree of soil level from the previous/past cycle, a degree of load size from previous cycles, a number of wash cycles performed after last self-clean cycle, and duration of idle state from the last self-clean cycle. The adaptive self-clean cycle may also manage the workload on the laundromat by providing the consumers with a different laundry machine when the user selects a specific laundry machine which is due for a self-clean cycle.

If the laundromat is too busy, then the self-clean cycle can start later without making potential customers wait. Also, consumers may be incentivized to perform such self-clean cycles. In this regard, the method may include sending an offer to the consumer in the form of a coupon to be used at the laundromat or a predefined laundromat within a network if the consumer agrees to perform the self-clean cycle during their usage. The commercial washers may be connected to a cloud-based remote server that may analyze operating conditions and not recommend a self-clean cycle to the consumer under various conditions, e.g., such as when more than a predetermined percentage of laundry machines within the laundromat are occupied. An artificial intelligence model may run to determine the usage capacity of the laundromat, e.g., based on weather conditions, holidays, time, etc. These conditions may be checked to avoid running the self-clean mode during peak usage of the laundromat, as this may cause financial losses to the owner.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method of operating a washing machine appliance comprising:

receiving a request to start a new wash cycle from a user;

determining that a self-clean condition exists;

identifying an anticipated laundromat capacity;

determining that the anticipated laundromat capacity falls below a predetermined capacity threshold;

prompting the user to initiate a self-clean cycle in response to determining that the self-clean condition exists and that the anticipated laundromat capacity falls below the predetermined capacity threshold;

receiving a command to initiate the self-clean cycle from the user; and initiating the self-clean cycle.

2. The method of claim 1, wherein determining that the self-clean condition exists comprises:

determining that a predetermined number of cycles has been performed since a performance of a prior self-clean cycle.

3. The method of claim 1, wherein determining that the self-clean condition exists comprises:

determining that a predetermined amount of time has passed since performing a prior self-clean cycle.

4. The method of claim 1, wherein determining that the self-clean condition exists comprises:

determining that an idle time measured between consecutive operating cycles exceeds a predetermined idle time.

5. The method of claim 1, wherein determining that the self-clean condition exists comprises:

determining that an accumulated soil level exceeds a predetermined soil threshold.

6. The method of claim 1, wherein identifying the anticipated laundromat capacity comprises:

identifying a current laundromat capacity; and determining the anticipated laundromat capacity based at least in part on the current laundromat capacity.

7. The method of claim 1, identifying the anticipated laundromat capacity comprises using a machine learning algorithm.

8. The method of claim 7, wherein the machine learning algorithm uses historical laundromat usage data to determine the anticipated laundromat capacity.

9. The method of claim 1, wherein determining that the anticipated laundromat capacity falls below the predetermined capacity threshold comprises:

determining a self-clean cycle time; and determining that the anticipated laundromat capacity during the self-clean cycle time falls below the predetermined capacity threshold.

10. The method of claim 1, wherein prompting the user to initiate the self-clean cycle comprises:

offering the user with an incentive for initiating the self-clean cycle; and providing the user with the incentive after the self-clean cycle is initiated.

11. The method of claim 10, wherein the incentive comprises at least one of a free or discounted wash cycle, a free or discounted dry cycle, or cycle credits.

12. The method of claim 1, wherein the washing machine appliance is in operative communication with a remote device through an external network, and wherein communications with the user are performed using the remote device.

13. A washing machine appliance operating in a commercial laundromat, the washing machine appliance comprising:

a wash tub positioned within a cabinet;

a wash basket rotatably mounted within the wash tub and defining a wash chamber configured for receiving a load of clothes;

a motor assembly mechanically coupled to the wash basket for selectively rotating the wash basket; and a controller operably coupled to the motor assembly, the controller being configured to:

receive a request to start a new wash cycle from a user;

determine that a self-clean condition exists;

identify an anticipated laundromat capacity;

determine that the anticipated laundromat capacity falls below a predetermined capacity threshold;

prompt the user to initiate a self-clean cycle in response to determining that the self-clean condition exists and that the anticipated laundromat capacity falls below the predetermined capacity threshold;

receive a command to initiate the self-clean cycle from the user; and initiate the self-clean cycle.

14. The washing machine appliance of claim 13, wherein determining that the self-clean condition exists comprises at least one of determining that a predetermined number of cycles has been performed since a performance of a prior self-clean cycle, determining that a predetermined amount of time has passed since the performance of a prior self-clean cycle, determining that an idle time measured between consecutive operating cycles exceeds a predetermined idle time, or determining that an accumulated soil level exceeds a predetermined soil threshold.

15. The washing machine appliance of claim 13, wherein identifying the anticipated laundromat capacity comprises:

identifying a current laundromat capacity; and determining the anticipated laundromat capacity based at least in part on the current laundromat capacity.

16. The washing machine appliance of claim 13, wherein prompting the user to initiate the self-clean cycle comprises:

offering the user with an incentive for initiating the self-clean cycle; and providing the user with the incentive after the self-clean cycle is initiated.

* * * * *